US011388496B2

(12) United States Patent
Rombach et al.

(10) Patent No.: US 11,388,496 B2
(45) Date of Patent: Jul. 12, 2022

(54) MICROELECTROMECHANICAL MICROPHONE HAVING A STOPPAGE MEMBER

(71) Applicant: TDK Corporation, Tokyo (JP)

(72) Inventors: Pirmin Rombach, Munich (DE); Kurt Rasmussen, Munich (DE); Dennis Mortensen, Munich (DE); Cheng-Yen Liu, Munich (DE)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 17/176,495

(22) Filed: Feb. 16, 2021

(65) Prior Publication Data

US 2021/0306727 A1 Sep. 30, 2021

Related U.S. Application Data

(60) Provisional application No. 63/002,021, filed on Mar. 30, 2020.

(51) Int. Cl.
*H04R 1/08* (2006.01)

(52) U.S. Cl.
CPC ..... *H04R 1/08* (2013.01); *H04R 2201/003* (2013.01)

(58) Field of Classification Search
CPC ... H04R 1/08; H04R 2201/003; H04R 19/016
See application file for complete search history.

(56) References Cited

U.S. PATENT DOCUMENTS

2013/0161702 A1* 6/2013 Chen ..... B81C 1/00246 257/E27.006
2016/0192082 A1* 6/2016 Uchida ..... H04R 31/00 257/416
2016/0360322 A1* 12/2016 Liu ..... H04R 19/005
2017/0013363 A1* 1/2017 Berger ..... H04R 19/04

* cited by examiner

*Primary Examiner* — Tuan D Nguyen
(74) *Attorney, Agent, or Firm* — Slater Matsil, LLP

(57) ABSTRACT

Technologies are provided for microelectromechanical microphones that can be robust to substantial pressure changes in the environment in which the micromechanical microphones operate. In some embodiments, a microelectromechanical microphone device can include a substrate defining a first opening to receive a pressure wave. The microelectromechanical microphone device also can include a flexible plate mechanically coupled to the substrate and a rigid plate mechanically coupled to the flexible plate. The flexible plate is deformable by the pressure wave. The rigid plate defines multiple openings that permit passage of the pressure wave. The microelectromechanical microphone device can further include at least one stoppage member assembled in a spatial relationship with the flexible plate. The at least one stoppage member can limit motion of the flexible plate in response to the pressure wave including a threshold amplitude.

22 Claims, 12 Drawing Sheets

MICROELECTROMECHANICAL MICROPHONE HAVING A STOPPAGE MEMBER

PRIORITY APPLICATION

This application claims the benefit of and priority to U.S. Provisional Application No. 63/002,021, filed Mar. 30, 2020, the content of which application is hereby incorporated by reference herein in its entirety.

BACKGROUND

There are situations in which a diaphragm of a microelectromechanical microphone can be subjected to sudden, large changes in air pressure. For example, the microelectromechanical microphone can fall on a hard surface during assembly into a device, such as a mobile telephone or wireless earbuds. Those sudden, large changes in air pressure can cause a substantial deformation of the diaphragm, resulting in damage to the diaphragm.

For some types of microelectromechanical microphones, overpressure valves in the diaphragm can be used to relieve some of the air pressure to which the microelectromechanical microphone is subjected. An overpressure valve can open during high-pressure load and, by relieving pressure, damage to the diaphragm can be avoided.

Unfortunately, overpressure valves can be detrimental to low frequency roll-off (LFRO) of a microelectromechanical microphone. In addition, overpressure valves can have rather slow opening times that may render them inadequate for abrupt, large changes in air pressure. Therefore, improved technologies for the reduction of damage to diaphragms in microelectromechanical microphones may be desired.

SUMMARY

The following presents a simplified summary of one or more of the embodiments in order to provide a basic understanding of one or more of the embodiments. This summary is not an extensive overview of the embodiments described herein. It is intended to neither identify key or critical elements of the embodiments nor delineate any scope of embodiments or the claims. The sole purpose of this Summary is to present some concepts of the embodiments in a simplified form as a prelude to the more detailed description that is presented later.

In an embodiment, the disclosure provides a microelectromechanical microphone device. The microelectromechanical microphone device includes a flexible plate configured to be deformed by a pressure wave. The microelectromechanical microphone device also includes a rigid plate mechanically coupled to the flexible plate. The rigid plate defines multiple openings that permit passage of the pressure wave. The microelectromechanical microphone device further includes a stoppage member affixed to the rigid plate and extending perpendicularly relative to a surface of the rigid plate opposite a surface of the flexible plate. The stoppage member has a distal surface that is separated from the surface of the flexible plate by a clearance distance. The stoppage member limits motion of the flexible plate in response to the pressure wave including a threshold amplitude.

In another embodiment, the disclosure provides a microelectromechanical microphone device. The microelectromechanical microphone device includes a substrate defining an opening to receive a pressure wave. The microelectromechanical microphone device also includes a flexible plate mechanically coupled to the substrate and configured to be deformed by the pressure wave. The microelectromechanical microphone device further includes a stoppage member affixed to the flexible plate and extending perpendicularly relative to a surface of the flexible plate opposite a surface of the substrate. The stoppage member has a distal surface that is separated from the surface of the substrate by a clearance distance. The stoppage member limits motion of the flexible plate in response to the pressure wave including a threshold amplitude.

In yet another embodiment, the disclosure provides a device. The device includes a microelectromechanical microphone device including a substrate defining a first opening to receive a pressure wave; a flexible plate mechanically coupled to the substrate and configured to be deformed by the pressure wave; a rigid plate mechanically coupled to the flexible plate, the rigid plate defining multiple openings that permit passage of the pressure wave; and at least one stoppage member assembled in a spatial relationship with the flexible plate. The at least one stoppage member limiting motion of the flexible plate in response to the pressure wave including a threshold amplitude. The device also includes a circuit coupled to the microelectromechanical microphone device and configured to receive a first signal indicative of a capacitance representative of an amplitude of the pressure wave. The circuit is further configured to generate a second signal representative of an amplitude of the pressure wave.

Other embodiments and various examples, scenarios and implementations are described in more detail below. The following description and the drawings set forth certain illustrative embodiments of the specification. These embodiments are indicative, however, of but a few of the various ways in which the principles of the specification may be employed. Other advantages and novel features of the embodiments described will become apparent from the following detailed description of the specification when considered in conjunction with the drawings.

DETAILED DESCRIPTION

Figure 1:
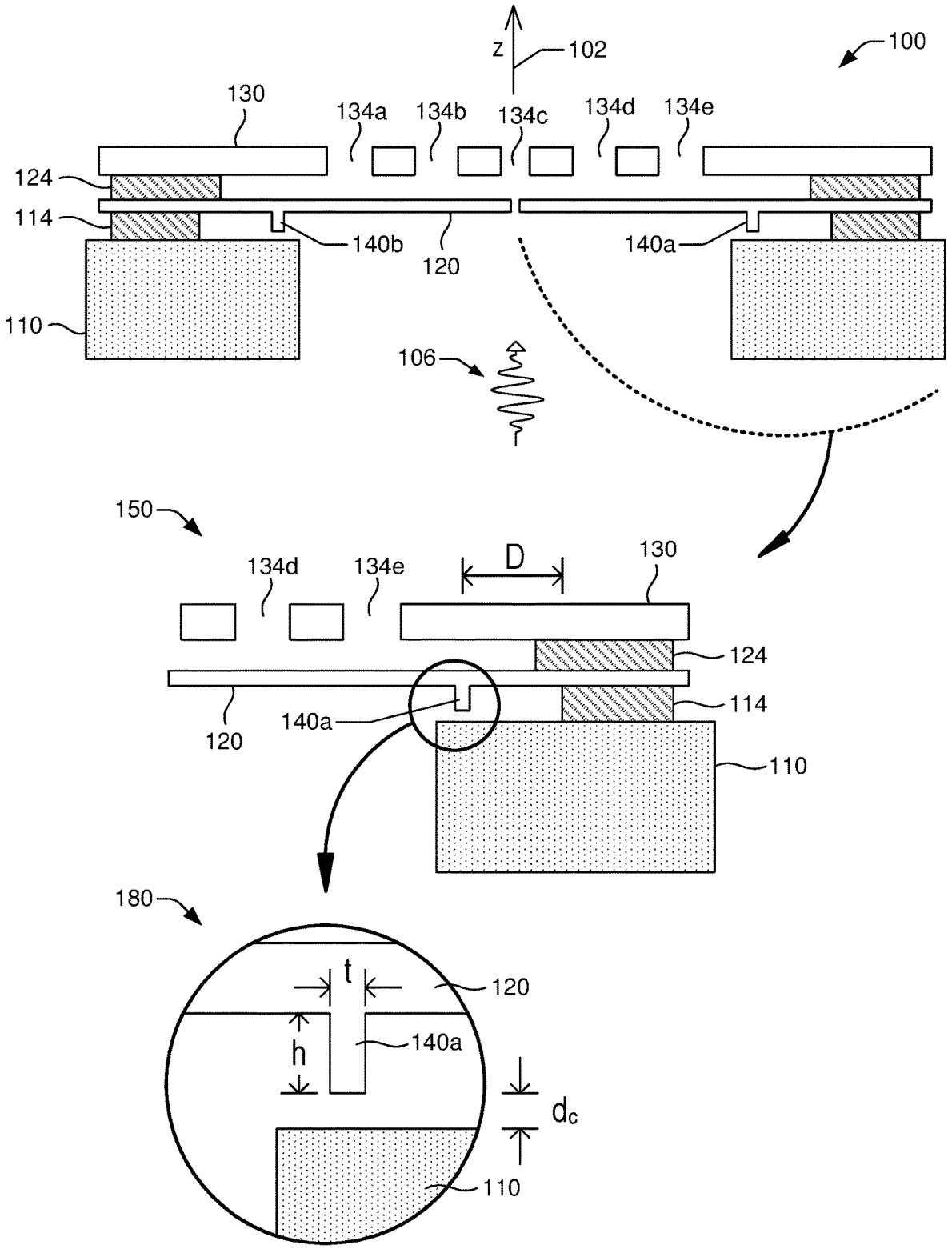
FIG. 1 illustrates a cross-sectional view of an example of a microelectromechanical microphone die, in accordance with one or more embodiments of the disclosure.

Embodiments of this disclosure address the issue of breakage of elements of microelectromechanical microphones when subjected to an abrupt, large change in air pressure. A microelectromechanical microphone can be subjected to substantial changes in air pressure during assembly of the microelectromechanical microphone into a device (such as a mobile telephone or a tablet computer) or during usage of the device, after assembly. In some situations, the microelectromechanical microphone can fall onto a hard surface in an assembly line. In other situations, the device containing the microelectromechanical microphone can fall. Substantial changes in air pressure can deflect a diaphragm of the microelectromechanical microphone by several or even tens of microns. Those changes can result in substantial stress in a vicinity of a suspension interface between the diaphragm and a support member within the microelectromechanical microphone. That stress can be particularly elevated in large microelectromechanical microphones with high signal-to-noise (SNR) ratio and fully suspended diaphragms. High stress may lead to the breakage of the diaphragm, with the ensuing failure of the microelectromechanical microphone.

Embodiments of this disclosure provide microelectromechanical microphones having stoppage members that limit a range of motion of diaphragms in the microelectromechanical microphones. In some embodiments, a stoppage member can be affixed to a backplate of the microelectromechanical microphone. The stoppage member can extend perpendicularly relative to a surface of the backplate opposite a surface of a diaphragm of the microelectromechanical microphone. The stoppage member can have a distal surface that is separated from the surface of the diaphragm by a clearance distance. The stoppage member can limit motion of the diaphragm in response to a pressure wave including a threshold amplitude. The threshold amplitude represents a threshold pressure (e.g., 0.1 bar, 0.5 bar, 1 bar, or 2 bar).

In other embodiments, a stoppage member can be affixed to the diaphragm of a microelectromechanical microphone. The stoppage member can extend perpendicularly relative to a surface of the diaphragm opposite a surface of a substrate of the microelectromechanical microphone. The stoppage member can have a distal surface that is separated from the surface of the substrate by a clearance distance. The stoppage member can limit motion of the diaphragm in response to a pressure wave including a threshold amplitude.

Regardless of the type of plate—diaphragm or backplate—to which a stoppage member is affixed to, the clearance distance can be uniform and can be within a range from about 10 nm to about 1 μm. Greater clearance distances can be implemented for microelectromechanical microphones that operate in rugged environments, whereas lesser clearance distances can be implemented for more fragile microelectromechanical microphones. In addition, in some embodiments, the stoppage member can be embodied in a discrete, localized structure. In other embodiments, the stoppage member can be embodied in an extended structure, such as an annular structure. Regardless of its structure, the stoppage member can have a uniform thickness within a range from about 0.5 μm to about 5.0 μm.

A stoppage member can be affixed to a plate, either a diaphragm or backplate, of a microelectromechanical microphone in numerous ways. In some cases, the stoppage member can be monolithically integrated into the plate. Further, a stoppage member can be formed from a same material as the material that constitutes the plate. In other embodiments, the stoppage member can be formed from a material that is different from the material that constitutes the plate. Simply as an illustration, the stoppage member can be formed from a dielectric material, such as silicon dioxide, aluminum oxide, silicon nitride, or aluminum nitride.

In contrast to conventional technologies, the incorporation of a stoppage member in a microelectromechanical microphone can provide fast response times to an intense pressure pulse, or train of pressure pulses, impinging on the diaphragm of the microelectromechanical microphone. Because the stoppage member can limit a range of motion of the diaphragm by structural contact with the diaphragm as the diaphragm deforms in response to a pressure pulse, a response time associated with inhibiting breakage of the diaphragm is comparable, if not the same as, the time duration of the air pressure pulse.

Further, the incorporation of a stoppage member into a microelectromechanical microphone does not alter a motion of the diaphragm responsive to acoustic waves having amplitudes corresponding to normal sound pressure intensities. Thus, the incorporation of one or several stoppage members is not detrimental to the performance of the microelectromechanical microphone.

With reference to the drawings, FIG. 1 illustrates various cross-sectional views of an example of a microelectromechanical microphone die 100 in accordance with one or more embodiments of the disclosure. The microelectromechanical microphone die 100 can constitute a microelectromechanical microphone device. The microelectromechanical microphone die 100 includes a substrate 110 that defines an opening to receive a pressure wave 106. The pressure wave 106 has amplitudes indicating respective pressures that can be greater than or less than atmospheric pressure. In some embodiments, rather than being relative to atmospheric pressure, those pressures can be relative to a reference pressure of the environment of the microelectromechanical microphone die 100. In some cases, the pressure wave 106 can correspond to an acoustic wave. Thus, the pressure wave 106 can have a waveform representative of an audio signal, such as an audible signal or an ultrasonic signal, or both. The audible signal can represent natural speech, an utterance, or environmental noise, for example. In other cases, the pressure wave 106 can have a waveform defining a single pulse or a train of pulses of large amplitude.

In some embodiments, the opening defined by the substrate 110 can be axially symmetric about an axis 102 (denoted as z, for the sake of nomenclature). For instance, the opening can have a circular perimeter. In other embodiments, the opening can be centrosymmetric relative to a geometric center of the opening. For instance, the opening can have a square perimeter or a hexagonal perimeter.

The substrate 110 can be formed from, or can include, a semiconducting material or an electrically insulating material (silicon dioxide, aluminum oxide (such as sapphire), or aluminum nitride, for example). In some embodiments, the semiconducting material can include silicon (amorphous, polycrystalline or crystalline); germanium; a semiconductor compound formed from an element in group III and another element in group V (referred to as a III-V semiconductor); a semiconductor compound formed from an element in group II and an element in group VI (referred to as a II-VI semiconductor); or a combination of two or more of the foregoing materials. Such a combination can be embodied in an alloy or a composite. In one example, the substrate 110 can be embodied in a silicon substrate. In another example, the substrate 110 can be embodied in a GaAs substrate. In yet another example, the substrate 110 can be embodied in a sapphire substrate. In still another example, the substrate 110 can be embodied in ZnS substrate.

The microelectromechanical microphone die 100 also includes a flexible plate 120 that is mechanically coupled to the substrate 110. A dielectric member 114 mechanically couples the flexible plate 120 to the substrate 110. The dielectric member 114 can be referred to as a "bottom spacer" and extends between the substrate 110 and the flexible plate 120.

The flexible plate 120 can embody, or can constitute, a diaphragm of a microelectromechanical microphone that includes the microelectromechanical microphone die 100. In some embodiments, the flexible plate 120 can be formed from a semiconductor or an electrically conducting material (such as a doped semiconductor or a metal). For example, the flexible plate 120 can be formed from silicon (amorphous, polycrystalline or crystalline); germanium; a III-V semiconductor; a II-VI semiconductor; or a combination (such as an alloy) of two or more of the foregoing materials. As another example, the flexible plate 120 can be formed from gold, silver, platinum, titanium, other types of noble metals, aluminum, copper, tungsten, chromium, or an alloy of two or more of the foregoing metals. In other embodiments, the flexible plate 120 can be formed from a composite material containing a dielectric (e.g., silicon dioxide, aluminum oxide, silicon nitride, or similar) and a semiconductor as is disclosed herein. In yet other embodiments, the flexible plate 120 can be formed entirely from a dielectric material. In such embodiments, the dielectric material is charged and operates as an electret material.

The electromechanical microphone die 100 also includes a rigid plate 130 that is mechanically coupled to the flexible plate 120. A dielectric member 124 mechanically couples the rigid plate 130 to the flexible plate 120. The dielectric member 124 can be referred to as an "airgap spacer" and extends between the rigid plate 130 and the flexible plate 120.

The rigid plate 130 can define multiple openings that can permit passage of air that transports the pressure wave 106. More generally, such openings can permit passage of a fluid that transports the pressure wave 106. As is illustrated in FIG. 1, the openings include a first opening 134*a*, a second opening 134*b*, a third opening 134*c*, a fourth opening 134*d*, and a fifth opening 134*e*.

The rigid plate 130 can embody, or can constitute, a backplate of the microelectromechanical microphone that includes the microelectromechanical microphone die 100. In some embodiments, the rigid plate 130 can be formed from a semiconductor or an electrically conducting material (e.g., a doped semiconductor or a metal). For example, the rigid plate 130 can be formed from silicon (amorphous, polycrystalline, or crystalline); germanium; a semiconductor compound from group III; a III-V semiconductor; a II-VI semiconductor; or a combination (such as an alloy) of two or more of the foregoing. As another example, the rigid plate 130 can be formed from gold, silver, platinum, titanium, other types of noble metals, aluminum, copper, tungsten, chromium, or an alloy of two or more of the foregoing metals. In other embodiments, the rigid plate 130 can be formed from a composite material containing a dielectric (e.g., silicon dioxide, aluminum oxide, silicon nitride, or similar) and a semiconductor as is disclosed herein. In yet other embodiments, the rigid plate 130 can be formed entirely from a dielectric material. In such embodiments, the dielectric material is charged and operates as an electret material.

The dielectric member 124 can be formed from an electrically insulating material, e.g., amorphous silicon, silicon dioxide, aluminum oxide, silicon nitride, or similar insulators. In some embodiments, as is depicted in FIG. 1, the dielectric member 114 and the dielectric member 124 can be formed from the same electrically insulating material, e.g., amorphous silicon, silicon dioxide, silicon nitride, or the like. In other embodiments, a particular combination of different materials can be utilized.

In some embodiments, the rigid plate 130 and the flexible plate 120 can be formed from the same electrically conducting material, e.g., a doped semiconductor or a metal. More generally, the rigid plate 130 can be formed from the same or similar material(s) as the flexible plate 120. For example, the rigid plate 130 can be formed from amorphous silicon, polycrystalline silicon, crystalline silicon, germanium, an alloy of silicon and germanium, a III-V semiconductor, a II-VI semiconductor, a dielectric (e.g., silicon dioxide, aluminum oxide, silicon nitride, aluminum nitride, and so forth), or a combination (such as an alloy or a composite) of two or more of the foregoing materials.

The flexible plate 120 can be configured to be deformed by the pressure wave 106. Specifically, the flexible plate 120 can include a suspended section that covers the opening defined by the substrate 110. In some embodiments, the suspended section also can be axially symmetric about the axis 102. For example, the suspended section also can have a circular perimeter. The dielectric member 114 and the dielectric member 124 can serve as suspension supports about which the suspended section of the flexible plate 120 can bend in response to the pressure wave 106. As is illustrated in FIG. 1, in some embodiments, the flexible plate 120 can define an opening at, or near, the geometric center of the suspended section.

The microelectromechanical microphone die 100 also includes a first stoppage member 140*a* that can be affixed to the flexible plate 120. The stoppage member 140*a* extends perpendicularly relative to a surface of the flexible plate 120, where the surface is opposite and essentially parallel to a surface of the substrate 110. The stoppage member 140*a* can be formed from a material that is different from the material that constitutes the flexible plate 120. For example, the material that constitutes the stoppage member 140 can be embodied in an electrically insulating material, such as silicon dioxide, aluminum oxide, silicon nitride, or aluminum nitride. In other embodiments, the stoppage member 140*a* can be formed from a same material as the material that constitutes the flexible plate 120.

The microelectromechanical microphone die 100 also includes a second stoppage member 140*b* that can be affixed to the flexible plate 120. The stoppage member 140*b* also extends perpendicularly relative to a surface of the flexible plate 120, where the surface is opposite and essentially parallel to a surface of the substrate 110. The stoppage member 140*b* can be formed from a material that is different from the material that constitutes the flexible plate 120. For example, the material that constitutes the stoppage member 140*b* can be embodied in an electrically insulating material, such as silicon dioxide, aluminum oxide, silicon nitride, or aluminum nitride. In other embodiments, the stoppage member 140*b* can be formed from a same material as the material that constitutes the flexible plate 120.

Diagram 150 in FIG. 1 illustrates a detail of a section of the microelectromechanical microphone die 100. As is shown in diagram 150, the stoppage member 140*a* can be placed at a particular distance D (a real number in units of length) from the dielectric member 114, toward the geometric center of the flexible plate 120.

In addition, diagram 180 in FIG. 1 illustrates another detail of the flexible plate 120, including the stoppage member 140*a*. As is shown in diagram 180, the stoppage member 140*a* can have a thickness t (a real number in units of length) and a height h (a real number in units of length). In some cases, t can have a magnitude within a range from about 0.5 μm to about 5 μm. The stoppage member 140*a* can be assembled to have a defined clearance from a surface of the substrate 110. The defined clearance can determine a range of motion of the flexible plate 120. More specifically, the stoppage member 140*a* can have a distal surface that is separated from the surface of the substrate 110 by a clearance distance $d_c$ (a real number in units of length). In some cases, $d_c$ can have a magnitude in a range from about 10 nm to about 1 μm, in some cases. The closer the stoppage member 140*a* is positioned toward the geometric center of the flexible plate 120, the greater the clearance distance can be.

While not shown in FIG. 1, the stoppage member 140*b* can have similar structural characteristics as the stoppage member 140*a*. Specifically, the stoppage member 140*b* can be placed at the distance D from the dielectric member 114, towards the geometric center of the flexible plate 120. The stoppage member 140*b* also can have the thickness t and the height h. The stoppage member 140*b* also can be assembled to have a defined clearance from a surface of the substrate 110. The defined clearance also can determine a range of motion of the flexible plate 120. More specifically, the stoppage member 140*b* also can have a distal surface that is separated from the surface of the substrate 110 by the clearance distance $d_c$.

Figure 2:
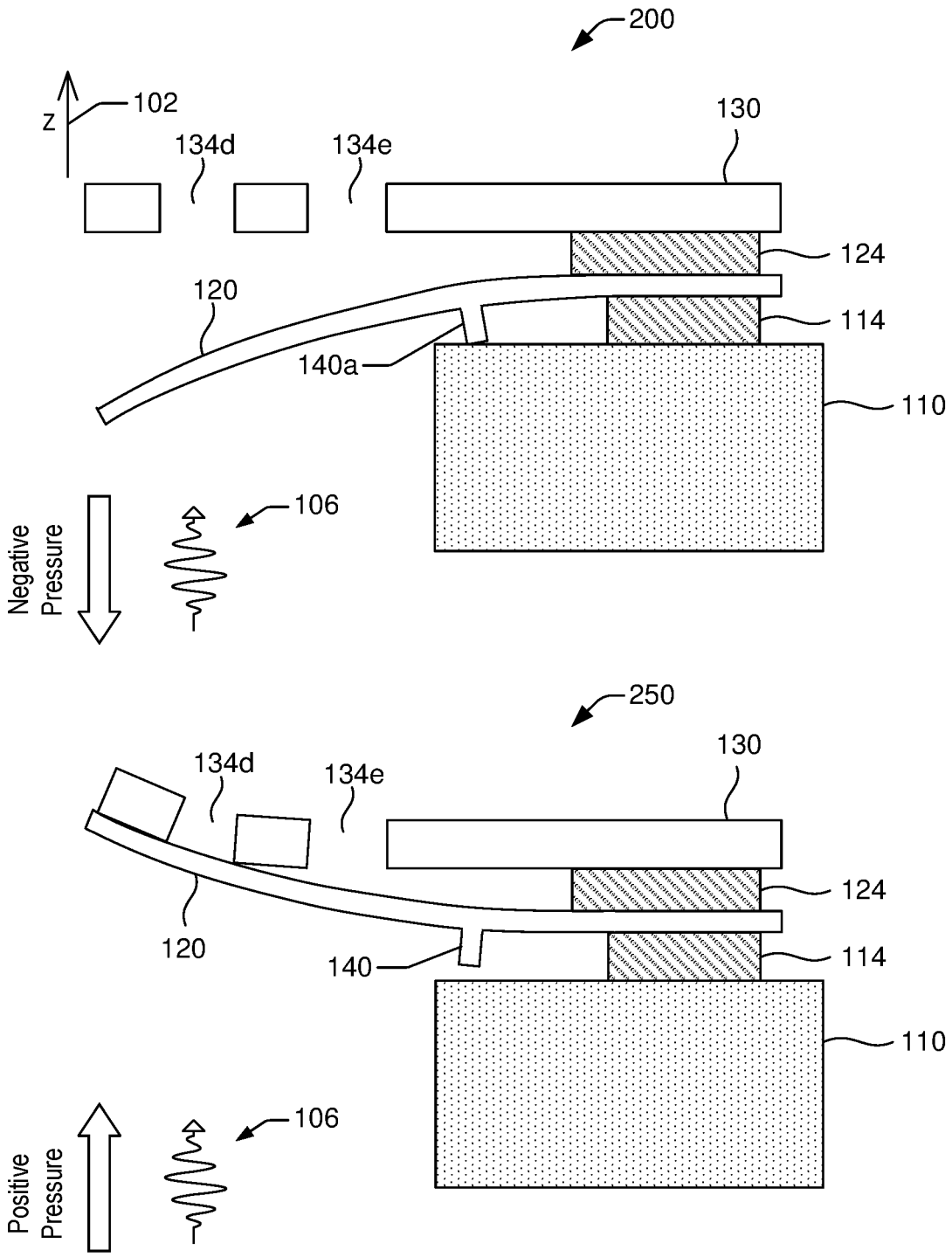
FIG. 2 illustrates an example of a scenario in which the microelectromechanical microphone die illustrated in FIG. 1 is subjected to high pressures.

FIG. 2 illustrates an example of a scenario in which the microelectromechanical microphone die 100 (FIG. 1) can be subjected to high pressure. As is shown in diagram 200, the stoppage member 140*a* can limit the motion of the flexible plate 120 in response to the pressure wave 106 including a threshold amplitude representing a threshold pressure. Simply as an illustration, the threshold pressure can be in a range from about 0.1 bar to 2 bar. In some cases, the threshold pressure can about 1 bar. Under negative pressure $P^{(-)}$—e.g., pressure that is less than atmospheric pressure or a pressure of an environment in which the microelectromechanical microphone 100 operates—the flexible plate 120 can be deflected away from the rigid plate 130, in a negative direction along the axis 102. When the magnitude of $P^{(-)}$ is equal to or greater than the threshold pressure, such a deflection can cause the stoppage member 140 to contact a surface of the substrate 110. By contacting the surface of the substrate 110 the stoppage member 140 can limit the range of motion of the flexible plate 120. As a result, stress in a vicinity of a bending point at the interface between the suspended section of the flexible plate 120 and the dielectric member 114 can be maintained below a threshold amount that results in fracture of the flexible plate 120.

Under positive pressure $P^{(+)}$ relative to atmospheric pressure (or the pressure of an environment in which the microelectromechanical microphone 100 operates), the flexible plate 120 can be deflected towards the rigid plate 130, in a positive direction along the axis 102. When the magnitude of $P^{(+)}$ is equal to or greater than the threshold pressure, the flexible plate 120 can deform the rigid plate 130 and the stoppage member 140 does not limit the range of motion of the flexible plate 120.

A stoppage member in accordance with aspects of this disclosure need not be assembled in a diaphragm of a microelectromechanical microphone in order to limit a range of motion of the diaphragm. The stoppage member also can be assembled in a backplate of the microelectromechanical microphone in order to limit the range of motion of the diaphragm.

Figure 3:
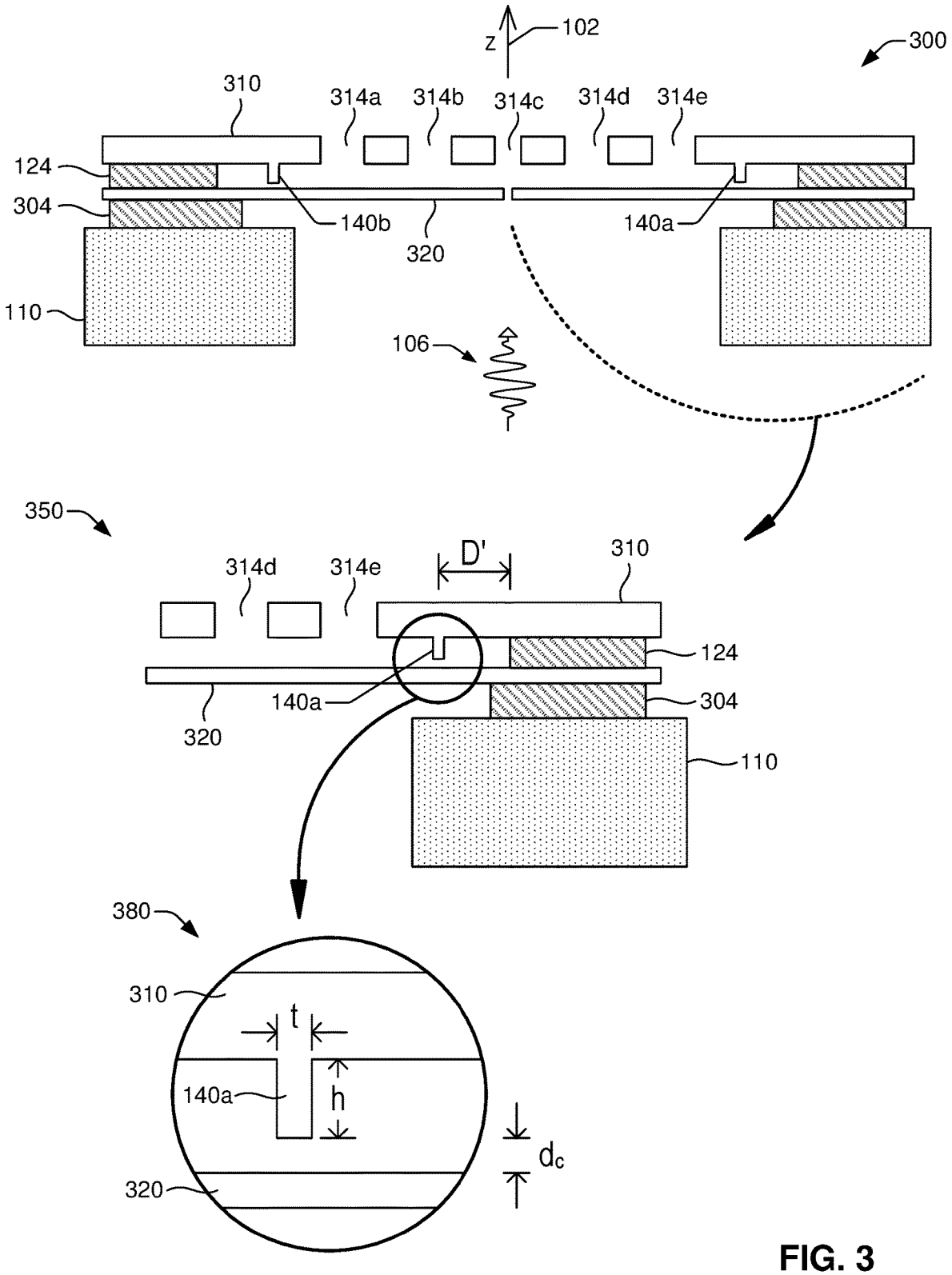
FIG. 3 illustrates a cross-sectional view of an example of a microelectromechanical microphone die, in accordance with one or more embodiments of the disclosure.

FIG. 3 illustrates various cross-sectional views of an example of a microelectromechanical microphone die 300 having a stoppage member 140*a* assembled in a rigid plate 310, in accordance with one or more embodiments of the disclosure. The microelectromechanical microphone die 300 can constitute a microelectromechanical microphone device. The rigid plate 310 can embody, or can constitute, a backplate of a microelectromechanical microphone that includes the microelectromechanical microphone die 300. The microelectromechanical microphone die 300 includes the substrate 110 defining an opening to receive pressure waves 106. As mentioned, in some embodiments, the opening can be axially symmetric about the axis 102. For instance, the opening can have a circular perimeter. Again, the substrate 110 can be formed from a semiconducting material or an electrically insulating material (sapphire or silicon dioxide, for example).

The electromechanical microphone die 300 also includes a flexible plate 320 that is mechanically coupled to the substrate 110. The dielectric member 304 mechanically couples the flexible plate 320 to the substrate 110. As is illustrated in FIG. 3, the dielectric member 304 extends between the substrate 110 and the flexible plate 320.

The flexible plate 320 can embody, or can constitute, a diaphragm of a microelectromechanical microphone that includes the microelectromechanical microphone die 300. In some embodiments, the flexible plate 320 can be formed from a semiconductor or an electrically conducting material (such as a doped semiconductor or a metal). For example, the flexible plate 320 can be formed from silicon (amorphous, polycrystalline or crystalline); germanium; a III-V semiconductor; a II-VI semiconductor; or a combination (such as an alloy) of two or more of the foregoing materials. As another example, the flexible plate 320 can be formed from gold, silver, platinum, titanium, other types of noble metals, aluminum, copper, tungsten, chromium, or an alloy of two or more of the foregoing metals. In other embodiments, the flexible plate 320 can be formed from a composite material containing a dielectric (e.g., silicon dioxide, aluminum oxide, silicon nitride, or similar) and a semiconductor as is disclosed herein. In yet other embodiments, the flexible plate 320 can be formed entirely from a dielectric material. In such embodiments, the dielectric material is charged and operates as an electret material.

As noted, the electromechanical microphone die 300 includes the rigid plate 310 mechanically coupled to the flexible plate 320. The dielectric member 124 mechanically couples the rigid plate 310 to the flexible plate 120. The dielectric member 124 extends between the rigid plate 310 and the flexible plate 320.

The rigid plate 310 defines multiple openings that can permit passage of air that transports the pressure wave 106. As mentioned, more generally, such openings can permit passage of a fluid that transports the pressure wave 106. As is illustrated in FIG. 3, the openings include a first opening 314*a*, a second opening 314*b*, a third opening 314*c*, a fourth opening 314*d*, and a fifth opening 314*e*.

In some embodiments, the rigid plate 310 can be formed from a semiconductor or an electrically conducting material (e.g., a doped semiconductor or a metal). For example, the rigid plate 310 can be formed from silicon (amorphous, polycrystalline or crystalline); germanium; a semiconductor compound from group III; a III-V semiconductor; a II-VI semiconductor; or a combination (such as an alloy) of two or more of the foregoing. As another example, the rigid plate 310 can be formed from gold, silver, platinum, titanium, other types of noble metals, aluminum, copper, tungsten, chromium, or an alloy of two or more of the foregoing metals. In other embodiments, the rigid plate 310 can be formed from a composite material containing a dielectric (e.g., silicon dioxide, aluminum oxide, silicon nitride, or similar) and a semiconductor as is disclosed herein. In yet other embodiments, the movable plate 110 can be formed entirely from a dielectric material. In such embodiments, the dielectric material is charged and operates as an electret material.

In some embodiments, the rigid plate 310 and the flexible plate 320 can be formed from the same electrically conducting material, e.g., a doped semiconductor or a metal. More generally, the rigid plate 310 can be formed from the same or similar material(s) as the flexible plate 320. For example, the rigid plate 310 can be formed from amorphous silicon, polycrystalline silicon, crystalline silicon, germanium, an alloy of silicon and germanium, a III-V semiconductor, a II-VI semiconductor, a dielectric (silicon dioxide, silicon nitride, aluminum oxide, aluminum nitride, and so forth), or a combination (such as an alloy or a composite) of two or more of the foregoing materials.

The flexible plate 320 can be configured to be deformed by the pressure wave 106. Specifically, the flexible plate 320 can include a suspended section that covers the opening defined by the substrate 110. The suspended section also can be axially symmetric about the axis 102. For example, the suspended section also can have a circular perimeter. The dielectric member 304 and the dielectric member 124 can serve as suspension supports about which the suspended section of the flexible plate 320 can bend in response to the pressure wave 106. As is illustrated in FIG. 3, in some embodiments, the flexible plate 320 can define an opening at, or near, the geometric center of the suspended section.

As mentioned, the microelectromechanical microphone 300 also includes the stoppage member 140*a* affixed to the rigid plate 310. The stoppage member 140*a* extends perpendicularly relative to a surface of the rigid plate 310, where the surface is opposite and essentially parallel to a surface of the flexible plate 320. The stoppage member 140*a* can be formed from a material that is different from the material that constitutes the rigid plate 310. For example, the material that constitutes the stoppage member 140*a* can be embodied in an electrically insulating material, such as silicon dioxide, aluminum oxide, silicon nitride, or aluminum nitride. In other embodiments, the stoppage member 140*a* can be formed from a same material as the material that constitutes the rigid plate 310.

The microelectromechanical microphone die 300 also includes the second stoppage member 140*b* affixed to the rigid plate 310. The stoppage member 140*b* also extends perpendicularly relative to a surface of the rigid plate 310, where the surface is opposite and essentially parallel to a surface of the flexible plate 320. The stoppage member 140*b* can be formed from a material that is different from the material that constitutes the rigid plate 310. For example, the material that constitutes the stoppage member 140*b* can be embodied in an electrically insulating material, such as silicon dioxide, aluminum oxide, silicon nitride, or aluminum nitride. In other embodiments, the stoppage member 140*b* can be formed from a same material as the material that constitutes the rigid plate 310.

Diagram 350 in FIG. 3 illustrates a detail of a section of the microelectromechanical microphone die 300. As is shown in diagram 350, the stoppage member 140*a* can be placed at a particular distance D' (a real number in units of length) from the dielectric member 124, toward the geometric center of the rigid plate 310.

In addition, diagram 380 in FIG. 3 illustrates another detail of the rigid plate 310 and the flexible plate 320, including the stoppage member 140*a*. As is shown in diagram 380, the stoppage member 140*a* can have the thickness t and the height h. As mentioned, in some cases, t can have a magnitude within a range from about 0.5 μm to about 5 μm. The stoppage member 140*a* can be assembled to have a defined clearance from a surface of the flexible plate 320. The defined clearance can determine a range of motion of the flexible plate 320. More specifically, the stoppage member 140*a* can have a distal surface that is separated from the surface of the flexible plate 320 by the clearance distance $d_c$. In some cases, $d_c$ can have a magnitude in a range from about 10 nm to about 1 μm, in some cases. The closer the stoppage member 140*a* is positioned toward the geometric center of the rigid plate 310, the greater the clearance distance can be.

Figure 4:
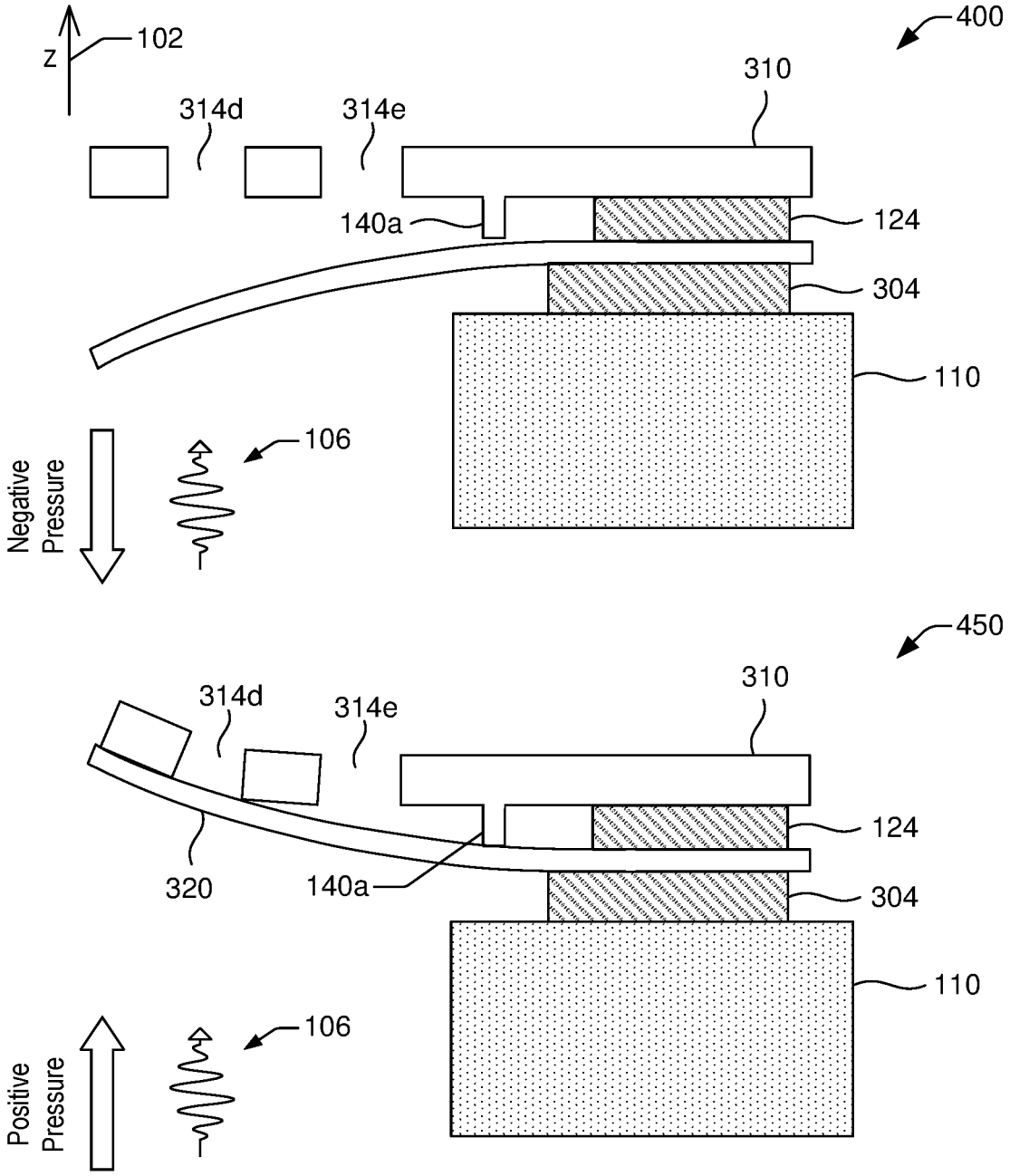
FIG. 4 illustrates an example of a scenario in which the microelectromechanical microphone die illustrated in FIG. 3 is subjected to high pressures.

FIG. 4 illustrates an example of a scenario in which the microelectromechanical microphone die 300 (FIG. 3) can be subjected to high pressure. The stoppage member 140 can limit the motion of the flexible plate 320 in response to the pressure wave 106 including a threshold amplitude representing a threshold pressure. As mentioned, the threshold pressure can be in a range from about 0.1 bar to 2 bar. In some cases, the threshold pressure can about 1 bar. Under negative pressure $P^{(-)}$—e.g., pressure that is less than atmospheric pressure or a pressure of an environment in which a microelectromechanical microphone including the die 300 operates—the flexible plate 320 can be deflected away from the rigid plate 310, in a negative direction along the axis 102. The stoppage member 140*a* does not limit the range of motion of the flexible plate 320 in such condition.

Under positive pressure P pressure that is greater than atmospheric pressure or a pressure of an environment in which a microelectromechanical microphone including the die 300 operates—the flexible plate 320 can be deflected towards the rigid plate 130, in a positive direction along the axis 102, as is shown in diagram 450. When the magnitude of $P^{(+)}$ is equal to or greater than the threshold pressure, such a deflection may cause the flexible plate 320 to deform the rigid plate 310. Such a deflection also can cause the stoppage member 140*a* to contact a surface of the flexible plate 320, as is shown in the diagram 450. By contacting the surface of the flexible plate 320, the stoppage member 140*a* can limit the range of motion of the flexible plate 320. As a result, although the flexible plate 320 may deform the rigid plate 130, stress in a vicinity of the interface between the suspended section of the flexible plate 320 and the dielectric member 124 can be maintained below a threshold amount that results in fracture of the flexible plate 320.

Regardless of type of plate—e.g., diaphragm or backplate—the stoppage member can be affixed to the plate in numerous ways. In one example, the stoppage member can be affixed by fusing a base of the stoppage member to a surface of the plate by means of a glue or another type of adhesive. In another example, the stoppage member can be affixed by monolithically integrating the stoppage member into the plate.

Figure 5:
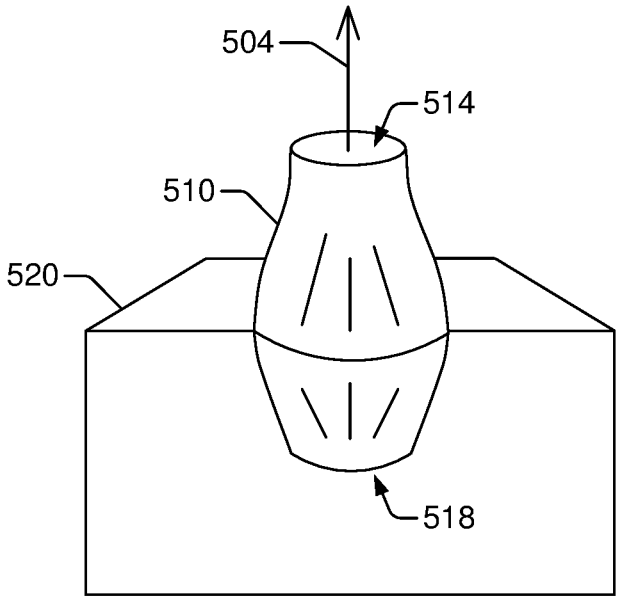
FIG. 5 illustrates a perspective view of an example for stoppage member, in accordance with one or more embodiments of this disclosure.

To that point, FIG. 5 illustrates a perspective view of an example of a stoppage member 510, in accordance with one or more embodiments of this disclosure. The stoppage member 510 can be monolithically integrated in into a plate 520. In some embodiments, the plate 520 embodies a diaphragm (such as the flexible plate 120 or the flexible plate 320) of a microelectromechanical microphone. In other embodiments, the plate 520 embodies a backplate (such as the rigid plate 130 or the rigid plate 310) of the microelectromechanical microphone. Accordingly, the plate 520 can be formed from a semiconductor or an electrically conducting material (e.g., a doped semiconductor or a metal). For example, the plate 520 can be formed from silicon (amorphous, polycrystalline or crystalline); germanium; a semiconductor compound from group III; a III-V semiconductor; a II-VI semiconductor; or a combination (such as an alloy) of two or more of the foregoing. As another example, the plate 520 can be formed from gold, silver, platinum, titanium, other types of noble metals, aluminum, copper, tungsten, chromium, or an alloy of two or more of the foregoing metals. In other embodiments, the plate 520 can be formed from a composite material containing a dielectric (e.g., silicon dioxide, aluminum oxide, silicon nitride, or similar) and a semiconductor as is disclosed herein. In yet other embodiments, the plate 520 can be formed entirely from a dielectric material. In such embodiments, the dielectric material is charged and operates as an electret material.

The stoppage member 510 is embodied in an object of revolution and, thus, can have axial symmetry about an axis 504 that pierces the stoppage member 510 perpendicularly to a first planar surface 514 of the stoppage member 510. Because the stoppage member 510 is monolithically integrated into the plate 520, the stoppage member 510 has a section embedded into the plate 520. Such a section can be tapered, ending in a second planar surface 518 interfacing with a portion of the plate 520. It is noted that stoppage member 510 lack a portion with a distinct interface to the plate 520.

Figure 6:
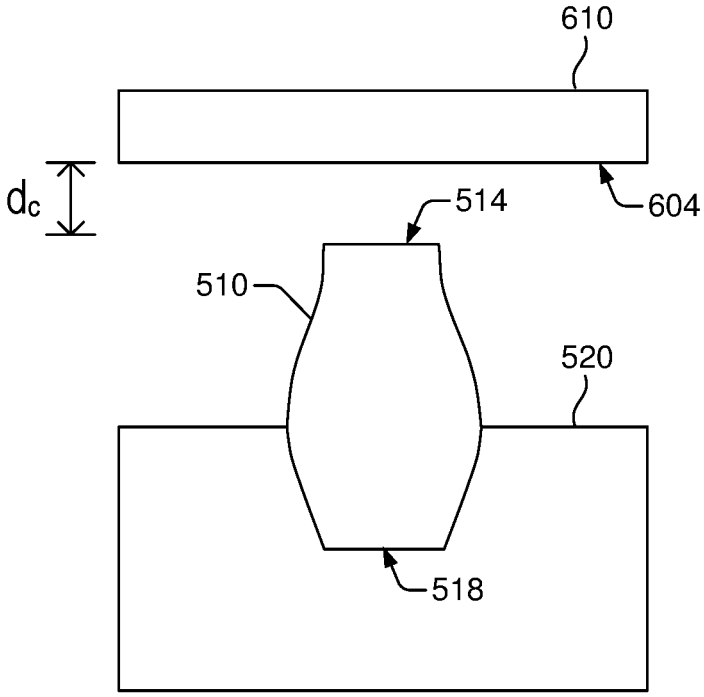
FIG. 6 illustrates a cross-sectional view of the stoppage member illustrated in FIG. 5, in accordance with one or more embodiments of this disclosure.

Similar to other stoppage members of this disclosure, a first material that forms the stoppage member 510 can be different from a second material that forms the plate 520. In some cases, the first material is a dielectric material and the second material is an electrical conductor material (such as polycrystalline silicon or a doped semiconductor). In one example, the dielectric material can be alumina, silicon nitride, or aluminum nitride As is illustrated in FIG. 6, the distal planar surface 514 can be located at a clearance distance $d_c$ from a surface 604 of a second plate 610. The plate 520 and the second plate 610 can constitute, at least partially, a microelectromechanical microphone. In an embodiment in which the plate 520 embodies a diaphragm (e.g., the flexible plate 120 (FIG. 1)) of the microelectromechanical microphone, the plate 610 can embody a backplate (e.g., the rigid plate 130 (FIG. 1)) of the microelectromechanical microphone. In an embodiment in which the plate 520 embodies the backplate, the plate 610 can embody the diaphragm.

Figure 7:
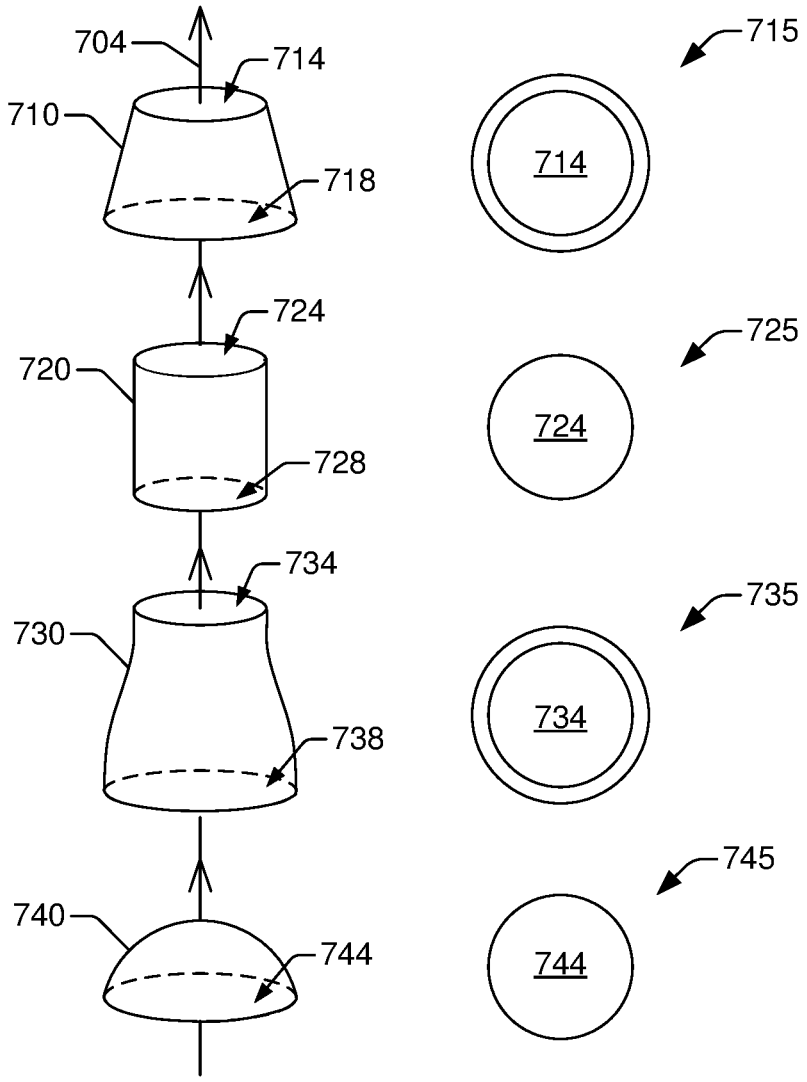
FIG. 7 illustrates examples of stoppage members, in accordance with one or more embodiments of this disclosure.

Stoppage members in accordance with aspects of this disclosure are not limited to objects of revolution. A stoppage member can have one of many shapes. FIG. 7 illustrates examples of stoppage members, in accordance with one or more embodiments of this disclosure. Each one of the illustrated stoppage members has axial symmetry (or is axially-symmetric) about an axis 704. As is illustrated in FIG. 7, a stoppage member 710 can be shaped as a truncated cone, a stoppage member 720 can be shaped as a cylinder, a stoppage member 730 can be an object of revolution, and a stoppage member 740 can be a dome. A stoppage member shaped as a dome can be assembled in a diaphragm or a backplate in embodiments in which a separation between the diaphragm and the backplate is small, e.g., less than 5 μm. Each one of those stoppage members can have cross-sections of cylindrical symmetry about the axis 704, as is shown in the top-view projections depicted in diagram 715, diagram 725, diagram 735, and diagram 745.

Stoppage member 710 can include a first planar surface 714 and a second planar surface 718 having respective circular perimeters. Diagram 715 presents a projection of the stoppage member 710 on a plane perpendicular to the axis 704, to illustrate the first planar surface 714 and the second planar surface 718. Stoppage member 720 can include a first planar surface 724 and a second planar surface 728 having respective circular perimeters. Diagram 725 presents a projection of the stoppage member 720 on a plane perpendicular to the axis 704, to illustrate the first planar surface 724 and the second planar surface 728. Stoppage member 730 can include a first planar surface 734 and a second planar surface 738 having respective circular perimeters. Diagram 735 presents a projection of the stoppage member 730 on a plane perpendicular to the axis 704, to illustrate the first planar surface 734 and the second planar surface 738. Diagram 745 presents a projection of the stoppage member 740 on a plane perpendicular to the axis 704, to illustrate the cross-section of the planar base 744.

Figure 8:
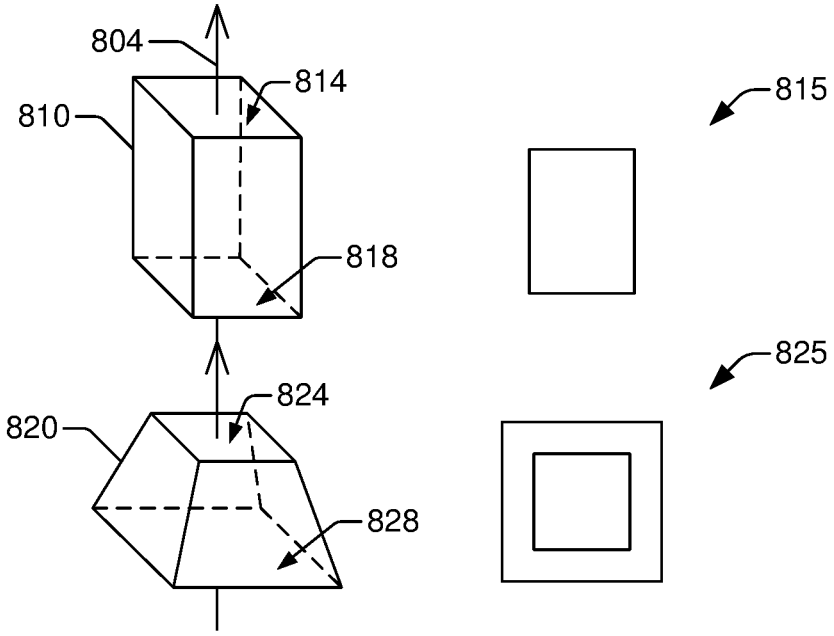
FIG. 8 illustrates examples of other stoppage members, in accordance with one or more embodiments of this disclosure.

FIG. 8 illustrates examples of other types of stoppage members, in accordance with one or more embodiments of this disclosure. Each one of the stoppage members has rotational symmetry about an axis 804. Both of the illustrated stoppage members have a $C_4$ cyclic symmetry group, for example. The stoppage member 810 is shaped as a parallelepiped. Accordingly, the stoppage member 810 has a cross-section that is rectangular, as is shown in diagram 815. The stoppage member 810 includes a first planar surface 814 and a second planar surface 818 having rectangular perimeters. Diagram 815 presents a projection of the stoppage member 810 on a plane perpendicular to the axis 804, to illustrate the first planar surface 814 and the second planar surface 818. The stoppage member 820 has a truncated pyramid shape. The stoppage member 820 includes a first planar surface 824 and a second planar surface 828 having respective rectangular perimeters. Diagram 825 presents a projection of the stoppage member 820 on a plane perpendicular to the axis 804, to illustrate the first planar surface 824 and the second planar surface 828.

Figure 9:
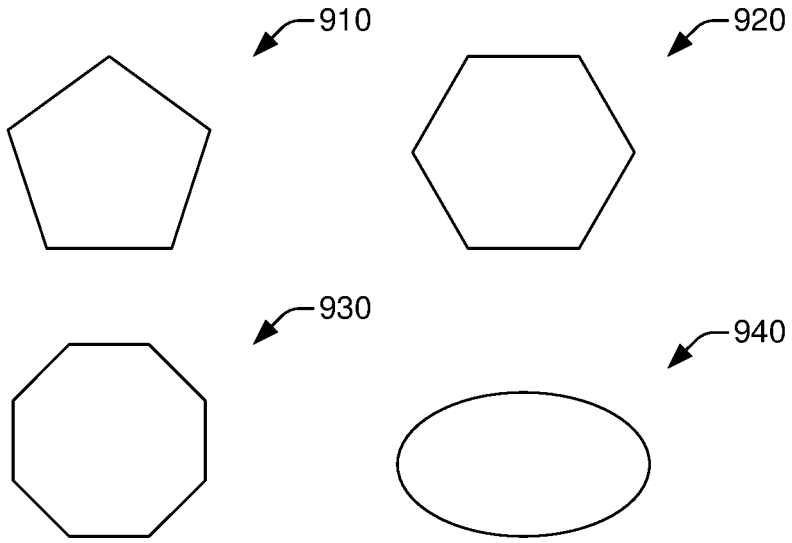
FIG. 9 illustrates various projection views of example of stoppage members, in accordance with one or more embodiments of this disclosure.

Stoppage members having other cross-sections geometries also can be fabricated. FIG. 9 illustrates various projection views of various example of stoppage members, in accordance with one or more embodiments of this disclosure. Diagram 910 depicts a stoppage member having a uniform pentagonal cross-section. Diagram 920 depicts a stoppage member having a uniform hexagonal cross-section. Diagram 930 depicts a stoppage member having a uniform octagonal cross-section. While not depicted in FIG. 9, stoppage members can have other respective polygonal cross-sections having a perimeter embodied in a regular polygon or an irregular polygon. Diagram 940 depicts a stoppage member having a uniform ellipsoidal cross-section.

Embodiments of this disclosure are not limited to microelectromechanical microphones having a specific number of stoppage members. A microelectromechanical microphone in accordance with this disclosure can have a single stoppage member or multiple stoppage members. In embodiments in which the microelectromechanical microphone has multiple stoppage member, those members can be arranged in one of many configurations.

Figure 10:
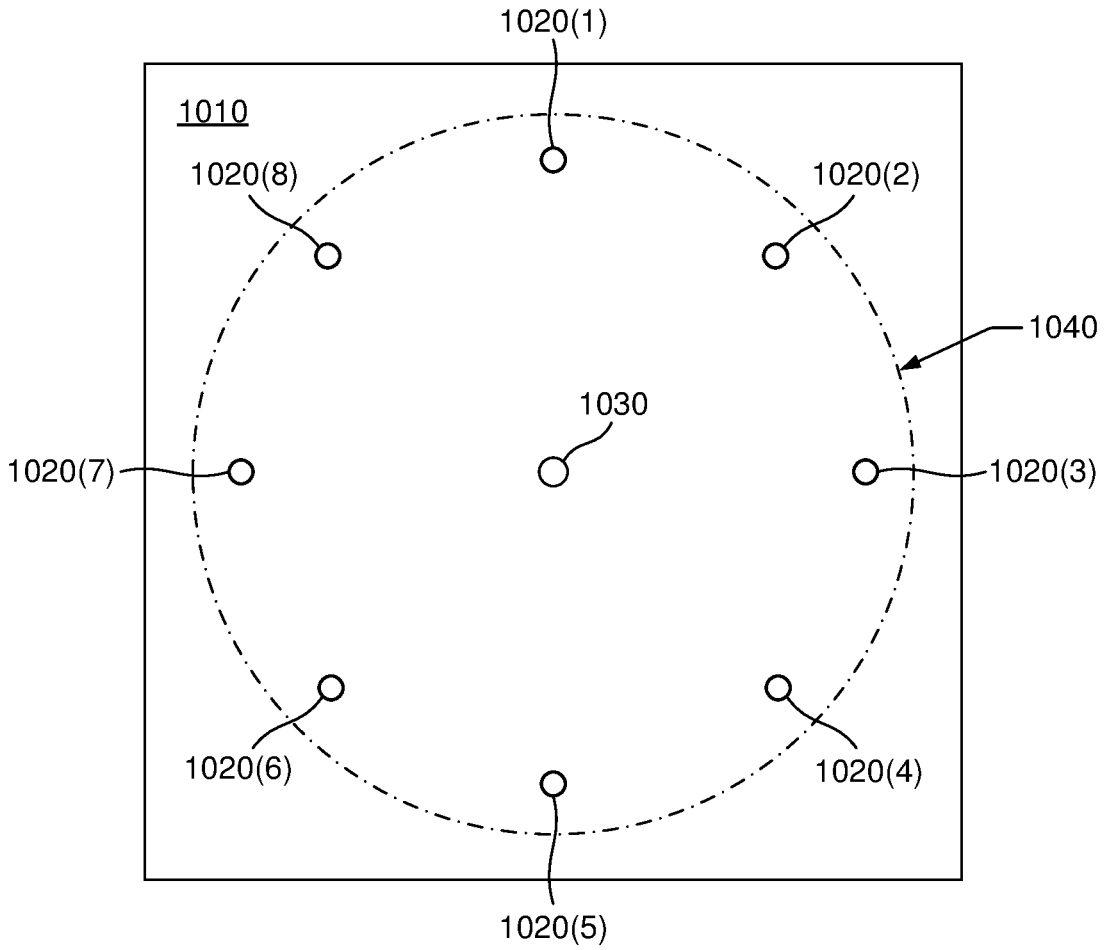
FIG. 10 illustrates an example of a configuration of stoppage members affixed to a flexible plate, in accordance with one or more embodiments of this disclosure.

As an illustration, FIG. 10 depicts an example of a configuration of stoppage members on a flexible plate 1010, in accordance with one or more embodiments of this disclosure. The stoppage members include a first stoppage member 1020(1), a second stoppage member 1020(2), a third stoppage member 1020(3), a fourth stoppage member 1020(4), a fifth stoppage member 1020(5), a sixth stoppage member 1020(6), a seventh stoppage member 1020(7), and an eight stoppage member 1020(8). The stoppage members are arranged on a symmetric configuration about an opening 1030 at a geometric center of the flexible plate 1010. As is illustrated in FIG. 10, the stoppage members are arranged uniformly along an arcuate path along a periphery 1040 that separates a suspended section of the flexible plate 1010 from a stationary section of the flexible plate 1010 attached to a dielectric space member (such as dielectric member 114 or dielectric member 304; not depicted in FIG. 10).

The arrangement of the illustrated stoppage members is not exclusive. In addition, although eight stoppage members are illustrated in FIG. 10, the disclosure is not limited in that respect. In some embodiments, a number of stoppage members that is greater or less than eight stoppage members can be assembled.

It is noted that in some scenarios, a large number of stoppage members can be justified by a rugged nature of an environment in which the microphone device having stoppage members can operate. In other scenarios, however, a microelectromechanical microphone can be expected to operate in an environment in which such a device is unlikely to experience abrupt, large changes in atmospheric pressure.

Figure 11:
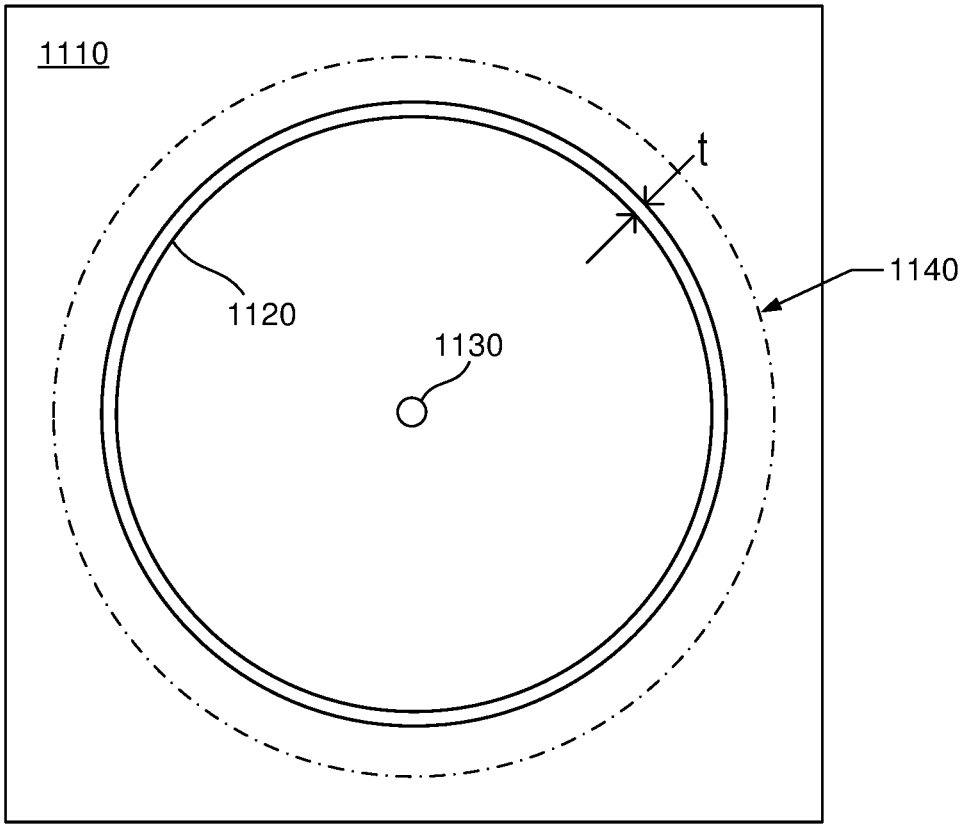
FIG. 11 illustrates an example of a stoppage member affixed to a flexible plate, in accordance with one or more embodiments of this disclosure.

In some embodiments, instead of being discrete, localized structures, a stoppage member can be extended across a plate—a diaphragm or a backplate—that constitutes a microelectromechanical microphone. FIG. 11 illustrates an example of a stoppage member 1120 on a flexible plate 1110, in accordance with one or more embodiments of this disclosure. The flexible plate 1110 can embody the flexible plate 120 or the flexible plate 310, or both. The stoppage member 1120 can have an annular shape that has circular symmetry about an axis that pierces the flexible plate 1110 through an opening 1130 at the geometric center of the flexible plate 1110. A surface of the stoppage member 1120 is located at a distance D from a periphery 1140 that separates a suspended section of the flexible member 1110 from a stationary section of the flexible plate 1110 attached to a dielectric space member (such as dielectric member 114 or dielectric member 304; not depicted in FIG. 11). The stoppage member 1120 can have a uniform height h and a uniform thickness t. A magnitude of t can be within a range from about 0.5 μm to about 5.0 μm.

The disclosure is not limited to annular shapes. Stoppage members that are extended can have other closed-loop structures having non-circular perimeters.

Figure 12:
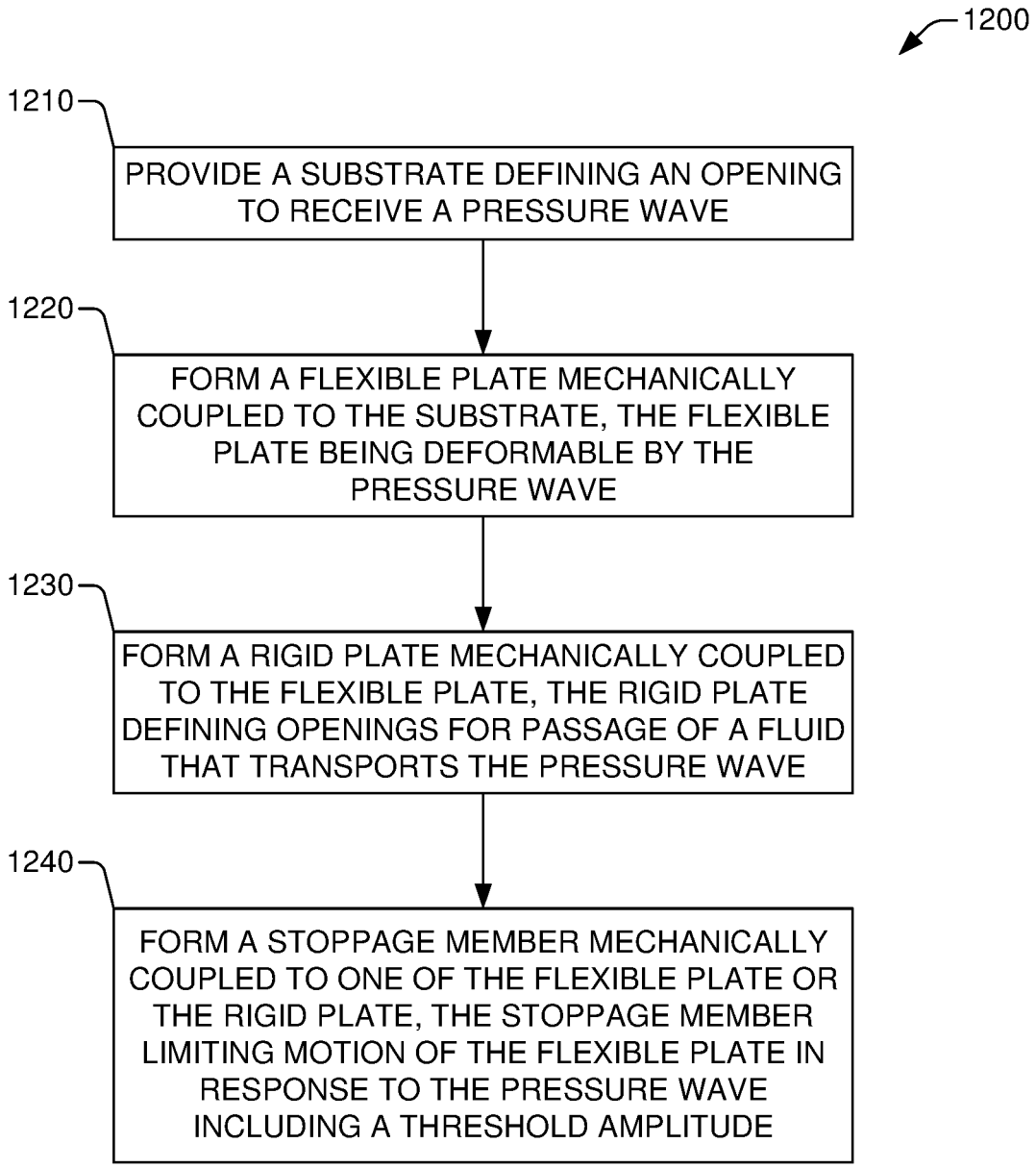
FIG. 12 illustrates an example of a method for providing a microelectromechanical microphone having a stoppage member, in accordance with one or more embodiments of this disclosure.

FIG. 12 illustrates an example of a method 1200 for limiting a range of motion of a diaphragm in a microelectromechanical microphone, in accordance with one or more embodiments of this disclosure. At block 1210, a substrate defining an opening to receive a pressure wave can be provided. In some embodiments, the opening can have a perimeter that axially-symmetric perimeter about an axis that is perpendicular to a planar surface of the substrate and pierces the planar surface at its geometric center. In other embodiments, the opening can have a perimeter that is centrosymmetric relative to that geometric center. In one example, the substrate can be embodied in the substrate 110 (FIG. 1) and the pressure wave can be embodied in the pressure wave 106 (FIG. 1).

At block 1220, a flexible plate mechanically coupled to the substrate can be formed. The flexible plate can be deformed by the pressure wave. The flexible plate can embody the diaphragm in the microelectromechanical microphone. The flexible plate can be formed from a semiconductor or an electrically conducting material. At block 1230, a rigid plate mechanically coupled to the flexible plate can be formed. The rigid plate defines multiple openings that permit passage of a fluid that transports the pressure wave. The rigid plate can be formed from a semiconductor or an electrically conducting material. The rigid plate can embody a backplate in the microelectromechanical microphone. In some embodiments, the rigid plate can embody the rigid plate 130 (FIG. 1). In other embodiments, the rigid plate can embody the rigid plate 310 (FIG. 3).

At block 1240, a stoppage member mechanically coupled to one of the flexible plate or the rigid plate can be formed. It is noted that, in some embodiments, block 1240 can be implemented during the implementation of block 1220 or block 1230, depending on whether the stoppage member is mechanically coupled to the flexible plate or the rigid plate. In some embodiments in which the stoppage member is mechanically coupled to the flexible plate, a pattern for the stoppage member can be defined before formation (e.g., deposition) of the flexible plate. Similarly, in some embodiments in which the stoppage member is mechanically coupled to the rigid plate, a pattern for the stoppage member can be defined before formation (e.g., deposition) of the rigid plate.

The formed stoppage member limits motion of the flexible plate in response to the pressure wave including a threshold amplitude. The stoppage member can be embodied in one of the stoppage member 140*a* or the stoppage member 140*b* (FIG. 1); the stoppage member 510 (FIG. 5); or the stoppage member 1120 (FIG. 11), for example. In some embodiments, the stoppage member is affixed to the rigid plate and extends perpendicularly relative to a surface of the rigid plate, where the surface is opposite a surface of the flexible plate. In addition, as mentioned, the stoppage member can have a distal surface that is separated from the surface of the flexible plate by a first clearance distance. The first clearance distance can have a magnitude in a range from about 10 nm to about 1 μm. In other embodiments, the stoppage member is affixed to the flexible plate and extends perpendicularly relative to a surface of the flexible plate, where the surface is opposite a surface of the substrate. In addition, as also mentioned, the stoppage member has a distal surface that is separated from the surface of the substrate by a second clearance distance. The second clearance distance can have a magnitude in a range from about 10 nm to about 1 μm.

Regardless of type of plate—e.g., flexible plate or rigid plate—the stoppage member can be affixed to the plate in numerous ways. In some embodiments, the stoppage member can be affixed by fusing a base of the stoppage member to a surface of the plate by means of a glue or another type of adhesive. In other embodiments, the stoppage member can be affixed by monolithically integrating the stoppage member into the plate. See FIG. 5, for example. In one of those embodiments, when the stoppage member is affixed to the flexible member, block 1220 and block 1240 can be implemented subsequently, followed by block 1230.

Figure 13A:
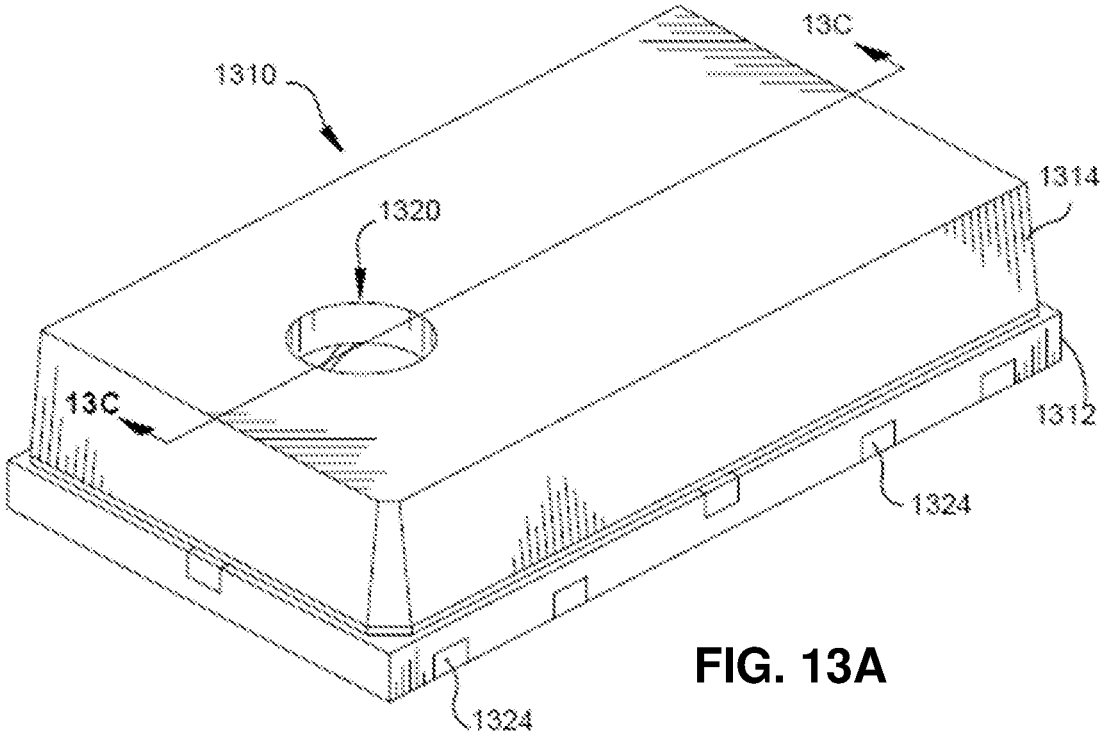
FIG. 13A illustrates a top perspective view of a packaged microphone having a microelectromechanical microphone die in accordance with one or more embodiments of this disclosure.

The microelectromechanical microphones having stoppage members in accordance with this disclosure can be packaged for operation within an electronic device (a mobile phone, a tablet computer, or a wireless earbud, for example) or other types of devices including consumer electronics and appliances, for example. As an illustration, FIG. 13A presents a top, perspective view of a packaged microphone 1310 that can include a microelectromechanical microphone die in accordance with one or more embodiments of this disclosure (such as the microelectromechanical microphone die 100 shown in FIG. 1 or the microelectromechanical microphone die 300 shown in FIG. 3). In addition, FIG. 13B presents a bottom, perspective view of the packaged microphone 1310.

As is illustrated, the packaged microphone 1310 has a package base 1312 and a lid 1314 that form an interior chamber or housing that contains a microelectromechanical microphone chipset 1316. In addition, or in other embodiments, such a chamber can include a separate microphone circuit chipset 1318. The chipsets 1316 and 1318 are depicted in FIG. 13C and FIG. 13D and are discussed hereinafter. In the illustrated embodiment, the lid 1314 is a cavity-type lid, which has four walls extending generally orthogonally from a top, interior face to form a cavity. In one example, the lid 1314 can be formed from metal or other conductive material to shield the microelectromechanical microphone die 1316 from electromagnetic interference. The lid 1314 secures to the top face of the substantially flat package base 1312 to form the interior chamber.

As is illustrated, the lid 1314 can have an audio input port 1320 that is configured to receive audio signals (e.g., audible signals and/or ultrasonic signals) and can permit such signals to ingress into the chamber formed by the package base 1312 and the lid 1314. In additional or alternative embodiments, the audio port 1320 can be placed at another location. For example, the audio port 1312 can be placed at the package base 1312. As another example, the audio port 1312 can be placed at one of the side walls of the lid 1314. Regardless of the location of the audio port 1312, audio signals entering the interior chamber can interact with the microelectromechanical microphone chipset 1316 to produce an electrical signal representative of at least a portion of the received audio signals. With additional processing via external components (such as a speaker and accompanying circuitry), the electrical signal can produce an output audible signal corresponding to an input audible signal contained in the received audio signals.

Figure 13B:
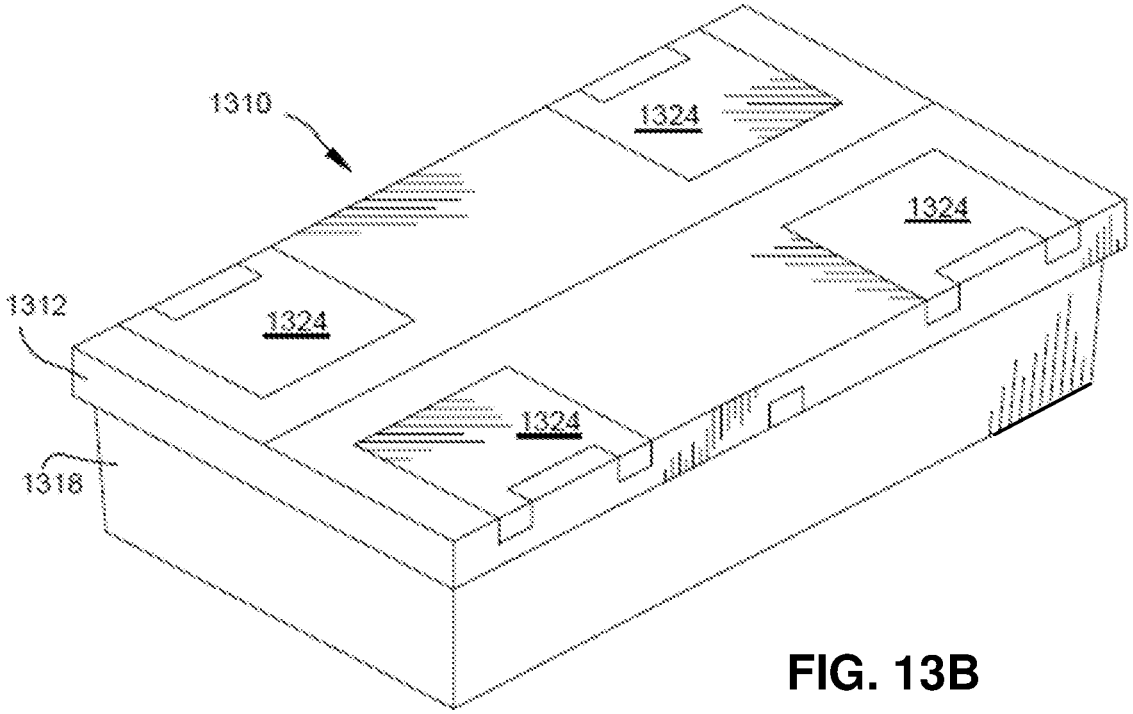
FIG. 13B illustrates a bottom perspective view of the packaged microphone illustrated in FIG. 13A.
Figure 13C:
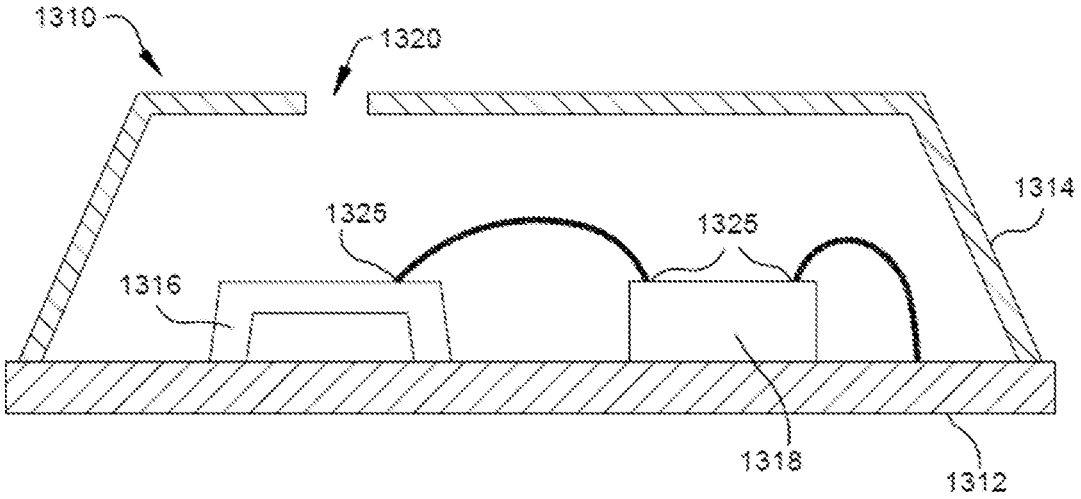
FIG. 13C illustrates a cross-sectional view of the packaged microphone illustrated in FIG. 13A.
Figure 13D:
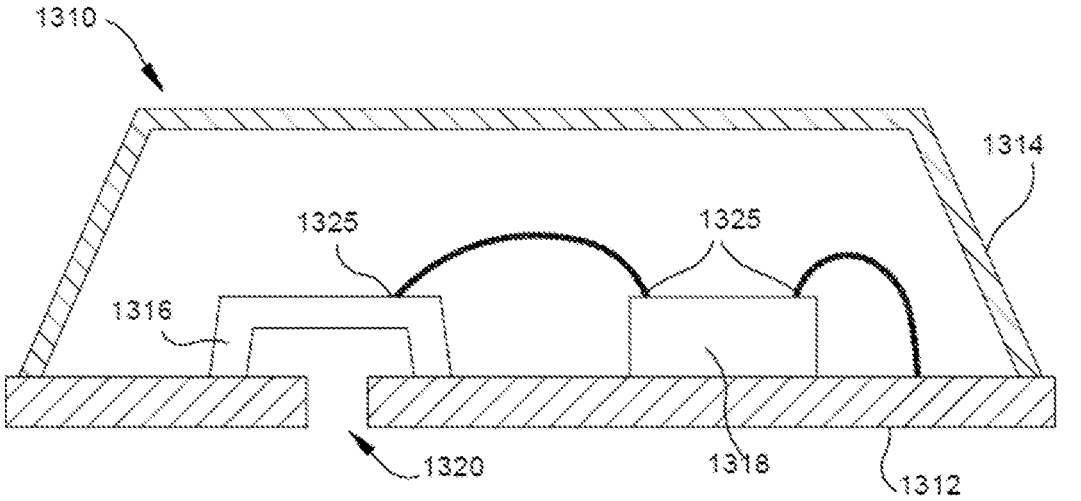
FIG. 13D illustrates a cross-sectional view of another example of a packaged microphone having a microelectromechanical microphone die in accordance with one or more embodiments of this disclosure.

FIG. 13B presents an example of a bottom face 1322 of the package base 1312. As illustrated, the bottom face 1322 has four contacts 1324 for electrically (and physically, in many use cases) connecting the microelectromechanical microphone chipset 1316 with a substrate, such as a printed circuit board or other electrical interconnect apparatus. Although four contacts 1324 are illustrated, the disclosure is not limited in that respect and other number of contacts can be implemented in the bottom face 1322. The packaged microphone 1310 can be used in any of a wide variety of applications. For example, the packaged microphone 1310 can be used with mobile telephones, landline telephones, computer devices, video games, hearing aids, hearing instruments, biometric security systems, two-way radios, public announcement systems, and other devices that transduce acoustic signals. In a particular implementation, the packaged microphone 1310 can be used within a speaker to produce audible signals from electrical signals.

In certain embodiments, the package base 1312 shown in FIG. 13A and FIG. 13B can be embodied in, or can contain, a printed circuit board material, such as FR-4, or a premolded, leadframe-type package (also referred to as a "premolded package"). Other embodiments may use or otherwise leverage different package types, such as ceramic cavity packages. Therefore, it is noted that this disclosure is not limited to a specific type of package.

FIG. 13C illustrates a cross-sectional view of the packaged microphone 1310 across line 13C-13C in FIG. 13A. As illustrated and discussed herein, the lid 1314 and base 1312 form an internal chamber or housing that contains a microelectromechanical microphone chipset 1316 and a microphone circuit chipset 1318 (also referred to as "microphone circuitry 1318") used to control and/or drive the microelectromechanical microphone chipset 1316. In certain embodiments, electronics can be implemented as a second, standalone integrated circuit, such as an application specific integrated circuit (e.g., an "ASIC die 1318") or a field programmable gate array (e.g., "FPGA die 1318"). It is noted that, in some embodiments, the microelectromechanical microphone chipset 1316 and the microphone circuit chipset 1318 can be formed on a single die.

Adhesive or another type of fastening mechanism can secure or otherwise mechanically couple the microelectromechanical microphone chipset 1316 and the microphone circuit chipset 1318 to the package base 1312. Wirebonds or other type of electrical conduits can electrically connect the microelectromechanical microphone chipset 1316 and microphone circuit chipset 1318 to contact pads (not shown) on the interior of the package base 1312.

While FIGS. 13A to 13C illustrate a top-port packaged microphone design, some embodiments can position the audio input port 1320 at other locations, such as through the package base 1312. For instance, FIG. 13D illustrates a cross-sectional view of another example of a packaged microphone 1310 where the microelectromechanical microphone chipset 1316 covers the audio input port 1320, thereby producing a large back volume. In other embodiments, the microelectromechanical microphone chipset 1316 can be placed so that it does not cover the audio input port 1320 through the package base 1312.

It is noted that the present disclosure is not limited with respect to the packaged microphone 1310 illustrated in FIGS. 13A to 13D. Rather, discussion of a specific packaged microphone is for merely for illustrative purposes. As such, other microphone packages including a microelectromechanical microphone having one or multiple stoppage members in accordance with this disclosure are contemplated herein.

Various aspects of the embodiments of this disclosure are described herein with reference to flowchart illustrations and/or block diagrams of methods. The flowchart and block diagrams in the Figures illustrate the architecture, functionality, and operation of possible implementations of devices, methods, and products according to various embodiments of this disclosure. In this regard, each block in the flowchart or block diagrams can represent one or several operations for implementing the specified function(s). In some implementations, the functions noted in the blocks can occur out of the order noted in the Figures. For example, two blocks shown in succession can, in fact, be implemented substantially concurrently, or the blocks can sometimes be implemented in the reverse order.

In the present specification, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in this specification and annexed drawings should generally be construed to mean "one or more" unless specified otherwise or clear from context to be directed to a singular form.

In addition, the terms "example" and "such as" are utilized herein to mean serving as an instance or illustration. Any embodiment or design described herein as an "example" or referred to in connection with a "such as" clause is not necessarily to be construed as preferred or advantageous over other embodiments or designs. Rather, use of the terms "example" or "such as" is intended to present concepts in a concrete fashion. The terms "first," "second," "third," and so forth, as used in the claims and description, unless otherwise clear by context, is for clarity only and doesn't necessarily indicate or imply any order in time.

What has been described above includes examples of one or more embodiments of the disclosure. It is, of course, not possible to describe every conceivable combination of components or methodologies for purposes of describing these examples, and it can be recognized that many further combinations and permutations of the present embodiments are possible. Accordingly, the embodiments disclosed and/or claimed herein are intended to embrace all such alterations, modifications and variations that fall within the spirit and scope of the detailed description and the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A microelectromechanical microphone device comprising;

a flexible plate configured to be deformed by a pressure wave;

a rigid plate mechanically coupled to the flexible plate, the rigid plate defining multiple openings that permit passage of the pressure wave; and a stoppage member affixed to the rigid plate and extending perpendicularly relative to a surface of the rigid plate opposite a surface of the flexible plate, the stoppage member having a distal surface that is separated from the surface of the flexible plate by a clearance distance, wherein the stoppage member is configured to limit motion of the flexible plate in response to the pressure wave including a threshold amplitude.

2. The microelectromechanical microphone device of claim 1, wherein the rigid plate is mechanically coupled to the flexible plate by a dielectric member that extends between the rigid plate and the flexible plate, and wherein the stoppage member is located at a defined distance from the dielectric member.

3. The microelectromechanical microphone device of claim 1, wherein the clearance distance has a magnitude in a range from 10 nm to 1 μm.

4. The microelectromechanical microphone device of claim 1, wherein the stoppage member is monolithically integrated into the rigid plate.

5. The microelectromechanical microphone device of claim 1, wherein the stoppage member is formed from a dielectric material or an insulator material.

6. The microelectromechanical microphone device of claim 1, wherein the stoppage member is formed from one of silicon dioxide, silicon nitride or aluminum nitride.

7. The microelectromechanical microphone device of claim 1, further comprising a second stoppage member affixed to the rigid plate and extending perpendicularly relative to the surface of the rigid plate opposite the surface of the flexible plate, the second stoppage member having a distal surface that is separated from the surface of the flexible plate by a clearance distance, wherein the second stoppage member further limits the motion of the flexible plate in response to the pressure wave having the threshold amplitude.

8. The microelectromechanical microphone device of claim 7, wherein the second stoppage member is located at a defined position along an arcuate path extending from the stoppage member, the arcuate path pertaining to a path that is centrosymmetric about an axis perpendicular to the surface of the rigid plate.

9. The microelectromechanical microphone device of claim 1, further comprising multiple second stoppage members affixed to the rigid plate, each one of the multiple second stoppage members extending perpendicularly relative to the surface of the rigid plate opposite the surface of the flexible plate.

10. The microelectromechanical microphone device of claim 9, wherein the multiple second stoppage members are uniformly distributed along a path that is centrosymmetric about an axis perpendicular to the surface of the rigid plate.

11. A microelectromechanical microphone device comprising:

a substrate defining an opening to receive a pressure wave;

a flexible plate mechanically coupled to the substrate and configured to be deformed by the pressure wave; and a stoppage member affixed to the flexible plate and extending perpendicularly relative to a surface of the flexible plate opposite a surface of the substrate, the stoppage member having a distal surface that is separated from the surface of the substrate by a clearance distance, wherein the stoppage member is configured to limit motion of the flexible plate in response to the pressure wave including a threshold amplitude.

12. The microelectromechanical microphone device of claim 11, wherein the substrate is mechanically coupled to the flexible plate by a dielectric member that extends between the substrate and the flexible plate, and wherein the stoppage member is located at a defined distance from the dielectric member.

13. The microelectromechanical microphone device of claim 11, wherein the clearance distance has a magnitude in a range from 10 nm to 1 μm.

14. The microelectromechanical microphone device of claim 11, wherein the stoppage member is monolithically integrated into the flexible plate.

15. The microelectromechanical microphone device of claim 11, further comprising a second stoppage member affixed to the flexible plate and extending perpendicularly relative to the surface of the flexible plate opposite the surface of the substrate, the stoppage member having a distal surface that is separated from the surface of the substrate by a clearance distance, wherein the second stoppage member further limits the motion of the flexible plate in response to the pressure wave having the threshold amplitude.

16. The microelectromechanical microphone device of claim 15, wherein the second stoppage member is located at a defined position along an arcuate path extending from the stoppage member, the arcuate path pertaining to a path that is centrosymmetric about an axis perpendicular to the surface of the flexible plate.

17. The microelectromechanical microphone device of claim 11, further comprising multiple second stoppage members affixed to a rigid plate, each one of the multiple second stoppage members extending perpendicularly relative to the surface of the rigid plate opposite the surface of the flexible plate.

18. The microelectromechanical microphone device of claim 17, wherein the multiple second stoppage members are uniformly distributed along a path that is centrosymmetric about an axis perpendicular to the surface of the flexible plate.

19. A device comprising:

a microelectromechanical microphone device comprising:

a substrate defining a first opening to receive a pressure wave;

a flexible plate mechanically coupled to the substrate and configured to be deformed by the pressure wave;

a rigid plate mechanically coupled to the flexible plate, the rigid plate defining multiple openings that permit passage of the pressure wave; and at least one stoppage member assembled in a spatial relationship with the flexible plate, the at least one stoppage member configured to limit motion of the flexible plate in response to the pressure wave including a threshold amplitude; and a circuit coupled to the microelectromechanical microphone device and configured to receive a first signal indicative of a capacitance representative of an amplitude of the pressure wave, the circuit being further configured to generate a second signal representative of the amplitude of the pressure wave.

20. The device of claim 19, wherein the at least one stoppage member comprises a first stoppage member affixed to the rigid plate and extending perpendicularly relative to a surface of the rigid plate opposite a surface of the flexible plate, the stoppage member having a distal surface that is separated from the surface of the flexible plate by a clearance distance.

21. The device of claim 19, wherein the at least one stoppage member comprises a first stoppage member affixed to the flexible plate and extending perpendicularly relative to a surface of the flexible plate opposite a surface of the substrate, the first stoppage member having a distal surface that is separated from the surface of the substrate by a clearance distance.

22. The device of claim 19, wherein the at least one stoppage member comprises a first stoppage member and a second stoppage member, wherein the first stoppage member is affixed to the rigid plate and extending perpendicularly relative to a surface of the rigid plate opposite a surface of the flexible plate, the stoppage member having a distal surface that is separated from the surface of the flexible plate by a first clearance distance, and wherein the second stoppage member is affixed to the flexible plate and extending perpendicularly relative to a surface of the flexible plate opposite a surface of the substrate, the second stoppage member having a distal surface that is separated from the surface of the substrate by a second clearance distance.

* * * * *